US008815790B2

(12) United States Patent
Masters et al.

(10) Patent No.: US 8,815,790 B2
(45) Date of Patent: Aug. 26, 2014

(54) FOAMING LIGHT DUTY LIQUID DETERGENT COMPOSITIONS, METHODS OF MAKING AND USES THEREOF

(75) Inventors: Ronald Anthony Masters, Glenview, IL (US); Brian Frank, Arlington Heights, IL (US)

(73) Assignee: Stepan Company, Northfield, IL (US)

( * ) Notice: Subject to any disclaimer, the term of this patent is extended or adjusted under 35 U.S.C. 154(b) by 0 days.

(21) Appl. No.: 13/524,421

(22) Filed: Jun. 15, 2012

(65) Prior Publication Data

US 2012/0295831 A1 Nov. 22, 2012

Related U.S. Application Data

(63) Continuation of application No. PCT/US2010/061020, filed on Dec. 17, 2010.

(60) Provisional application No. 61/287,496, filed on Dec. 17, 2009.

(51) Int. Cl.
*C11D 17/00* (2006.01)

(52) U.S. Cl.
USPC ..... 510/432; 510/237; 510/123

(58) Field of Classification Search
USPC ..... 510/432, 237, 123
See application file for complete search history.

(56) References Cited

U.S. PATENT DOCUMENTS

| | | | | | |
|---|---|---|---|---|---|
| 4,627,931 | A * | 12/1986 | Malik | ..... | 510/182 |
| 5,076,954 | A * | 12/1991 | Loth et al. | ..... | 134/40 |
| 5,646,103 | A * | 7/1997 | Kottwitz et al. | ..... | 510/361 |
| 6,096,701 | A * | 8/2000 | Mondin et al. | ..... | 510/382 |
| 6,107,263 | A | 8/2000 | D'Ambrogio et al. | | |
| 6,346,508 | B1 * | 2/2002 | Leonard et al. | ..... | 510/417 |
| 7,375,067 | B2 * | 5/2008 | Hayashi et al. | ..... | 510/237 |
| 7,718,595 | B2 * | 5/2010 | Murphy et al. | ..... | 510/424 |
| 2009/0312226 | A1 * | 12/2009 | Szewczyk et al. | ..... | 510/414 |
| 2009/0312227 | A1 * | 12/2009 | Murphy et al. | ..... | 510/414 |

FOREIGN PATENT DOCUMENTS

| | | | |
|---|---|---|---|
| CN | 1067673 | A | 1/1993 |
| EP | 0854182 | A2 | 7/1998 |
| EP | 2110462 | A1 | 10/2009 |
| WO | WO 86/04349 | | 7/1986 |
| WO | WO 97/49788 | | 12/1997 |
| WO | WO9749788 | * | 12/1997 |
| WO | 2006004721 | A1 | 1/2006 |

OTHER PUBLICATIONS

Int'l Prelim. Report on Patentability for PCT/US2010/061220 mailed Jun. 29, 2012.
International Search Report and Written Opinion for PCT/US2010/061220 mailed Feb. 14, 2011.

* cited by examiner

*Primary Examiner* — Liam J Heincer
*Assistant Examiner* — M. Reza Asdjodi
(74) *Attorney, Agent, or Firm* — McAndrews, Held & Malloy, Ltd.

(57) ABSTRACT

Foaming light duty liquid detergent formulations that contain at least one cleaning solvent, at least one anionic surfactant and at least foam stabilizing surfactant are disclosed. The compositions of the presently described technology are useful for soil removal applications including, but not limited to, washing dishes by hand and cleaning bathroom and kitchen articles and/or surfaces.

10 Claims, No Drawings

FOAMING LIGHT DUTY LIQUID DETERGENT COMPOSITIONS, METHODS OF MAKING AND USES THEREOF

RELATED APPLICATIONS

This application is a continuation of International application Serial No. PCT/US2010/061020 (International Publication No. WO11/075642), having an international filing date of Dec. 17, 2010. This PCT application claims priority to and claims benefit from U.S. provisional patent application Ser. No. 61/287,496 filed Dec. 17, 2009. The entire specifications of the PCT and provisional applications referred to above are hereby incorporated by reference.

BACKGROUND OF THE INVENTION

The present technology, in general, relates to foaming light duty liquid (LDL) detergent compositions that provide desirable foaming and increased soil and grease removal properties. Light duty liquid detergent compositions and/or formulations including pre-soak dishwashing liquids and hard surface kitchen and bath cleaners and uses thereof are also disclosed.

Desirable attributes for light duty liquid detergents (LDLs), in general, include the ability to emulsify, suspend or penetrate greasy or oily soils and suspend or disperse particulates, in order to clean articles or surfaces; and then prevent the soils, grease, or particulates from re-depositing on the newly cleaned articles or surfaces. It is also desirable for the light duty liquid to provide sustained foaming in dilute wash solution in the presence of the soils being cleaned. In order to provide the desired properties to rapidly clean grease and baked or dried-on food soils, cleaning solvents have been used, particularly in pre-soak detergents, but they have not been able to provide the foam and foaming longevity sufficient to be used as a dilute wash solution or LDL. Sparingly water-soluble cleaning solvents in particular are known to destroy foam performance. It has been a challenge, for example, for the detergent industry to provide a product that produces useful levels of foam in the presence of large quantities of greasy soil. Surprisingly, the present technology demonstrates one or more formulations of light duty liquid detergent compositions comprising a cleaning solvent that provide cleaning ability while maintaining the desired foaming properties.

BRIEF SUMMARY OF THE INVENTION

In one aspect, the present technology provides at least one foaming light duty liquid detergent composition having about 0.5% to about 10% active weight based on the total weight of the composition of at least one cleaning solvent; about 6.0% to about 40% of the total weight of at least one anionic surfactant; about 6.0% to about 40% of the total weight of at least one foam stabilizing surfactant; and 0.0% to about 90% of the total weight of at least one carrier, wherein the cleaning solvent is selected from the group consisting of methyl laurate, ethyl laurate, methyl myristate, ethyl myristate, C12-C14 methyl ester, C8-14 dimethyl amides, C8-14 diethyl amides, derivatives thereof and combinations thereof. In some aspects, the foaming liquid detergent composition which contains effective levels of sparingly water-soluble cleaning solvent provides nearly equal (similar) foam performance when compared with a liquid detergent composition not containing the selected cleaning solvent.

Another aspect of the present technology provides at least one foaming liquid detergent composition having about 0.5% to about 10% active weight based on the total weight of the composition of at least one cleaning solvent; about 6.0% to about 40% of the total weight of at least one anionic surfactant; about 6.0% to about 40% of the total weight of at least one foam stabilizing surfactant; and 0.0% to about 90% of the total weight of at least one carrier. In some aspects, the foaming liquid detergent composition exhibits foam performance as measured by foam mileage of at least about 1.6 grams, more preferably at least about 1.8 grams as measured by the automated Crisco-only gram test. The foam mileage generally tracks with the amount of total actives total actives. In some aspects, the foam mileage of the present technology is measured for compositions with total active amounts of about 23% to about 27% of the composition.

In yet another aspect, the one or more detergent compositions of the present technology exhibit adequate foam performance as measured by foam mileage of at least 10 plates, preferably at least 12 plates as measured by the mini-plate test with Crisco shortening soil. In some aspects, the foam mileage of the present technology is calculated for compositions with total active amounts of about 23% to about 27% of the composition.

In other aspects of the present technology, there is provided at least one light duty detergent comprising at least one cleaning solvent, at least one anionic surfactant, and at least one foam stabilizing surfactant, wherein the ratio of the at least one anionic surfactant to the at least one foam stabilizing surfactant is between about 2:1 to about 1:2, preferably about 1:1.

A further aspect of the present technology provides at least one foaming liquid detergent composition including about 0.5% to about 4% active weight based on total weight of at least one cleaning solvent; about 6.0% to about 10% active weight based on total weight of at least one anionic surfactant; about 6.0% to about 15% active weight based on total weight of at least one foam stabilizing surfactant; and 0.0% to about 90% based on total weight of one carrier.

In another aspect, the present technology provides a hard surface cleaner composition comprising about 0.5% to about 10% active weight based on the total weight of the composition of at least one cleaning solvent; about 6.0% to about 15% active weight based on the total weight of the composition of at least one anionic surfactant; about 6.0% to about 40% active weight based on the total weight of the composition of at least one foam stabilizing surfactant; and 0% to about 90% of the total weight of at least one carrier, wherein the cleaning solvent is selected from the group consisting of methyl laurate, ethyl laurate, methyl myristate, ethyl myristate, C12-C14 methyl ester, C8-14 dimethyl amides, C8-14 diethyl amides, derivatives thereof and combinations thereof; and wherein the hard surface cleaner which contains these effective levels of sparingly water-soluble cleaning solvent provides at least equivalent to foam performance when compared with a hard surface cleaner not containing any cleaning solvents. In some aspects, the hard surface cleaner is diluted at least 1:10 with water. In other aspects, the hard surface cleaner is diluted at least 1:50, alternatively 1:100, alternatively 1:500, alternatively 1:1000 in water.

In another aspect, the present technology provides a hard surface cleaner wherein the composition comprises about 0.5% to about 4% active weight based on the total weight of at least one cleaning solvent; about 6% to about 10% active weight based on the total weight of at least one anionic surfactant; about 6% to about 15% active weight based on the total weight of at least one foam stabilizing surfactant; and 0% to about 80% based on total weight of at least one carrier.

In another aspect, the present technology provides a pre-soak dishwashing composition comprising: 0.5% to about 10% active weight based on the total weight of at least one cleaning solvent; 6.0% to about 25% active weight based on the total weight of at least one anionic surfactant; 6.0% to about 25% active weight based on the total weight of at least one foam stabilizing surfactant; and 0.0% to about 90% of the total weight of at least one carrier. In some aspects, the pre-soak dishwashing composition comprises a cleaning solvent selected from the group consisting of methyl laurate, ethyl laurate, methyl myristate, ethyl myristate, C12-C14 methyl ester, C8-14 dimethyl amides, C8-14 diethyl amides, derivatives thereof and combinations thereof. In some aspects, the pre-soak dishwashing composition which contains effective levels of sparingly water-soluble cleaning solvent provides at least equivalent foam performance when compared with a pre-soak dishwashing composition not containing any cleaning solvents.

In yet another aspect, the present technology provides a ready to use cleaning composition comprising an at least 1:10 dilution of a composition comprising about 0.5% to about 10% active weight based on the total weight of the composition of at least one cleaning solvent; about 6.0% to about 15% active weight based on the total weight of the composition of at least one anionic surfactant; about 6.0% to about 15% active weight based on the total weight of the composition of at least one foam stabilizing surfactant; and 0% to about 90% of the total weight of at least one carrier. The ready to use cleaning composition comprises a cleaning solvent selected from the group consisting of methyl laurate, ethyl laurate, methyl myristate, ethyl myristate, C12-C14 methyl ester, C8-14 dimethyl amides, C8-14 diethyl amides, derivatives thereof and combinations thereof. The ready to use cleaning composition which contains effective levels of sparingly water-soluble cleaning solvent provides at least equivalent foam performance when compared with a ready to use composition not containing any cleaning solvents.

Yet a still further aspect of the present technology provides at least one hard surface cleaner for use in the kitchen or bath comprising at least one liquid detergent composition including at least one cleaning solvent, at least one anionic surfactant, at least one foam stabilizing surfactant, and a carrier, wherein the composition is dilutable from about 1:10 to about 1:1000 in water.

DETAILED DESCRIPTION OF THE INVENTION

The present technology generally relates to one or more foaming light duty liquid detergent compositions that contain at least one cleaning solvent, at least one anionic surfactant and at least one foam stabilizing surfactant which provides the desired foam for a liquid dish detergent and grease and soil removal.

It is desirable to enhance the ability of manual liquid dish detergent compositions to rapidly clean grease and dried-on food soils. The ability for such compositions to provide sufficient amounts of foam and to continue to foam as dishes are washed are important signals of manual dish detergent end-product performance to the consumer. Conventionally, to achieve the desired cleaning ability, cleaning solvents have been added to manual or light duty liquid detergent compositions which usually harm foam performance and thus have been used mainly as pre-soak products where foam is not required. There is a need in the art for formulations of manual dishwashing liquids that provide a balance between cleaning performance and desired foam performance. The present technology provides formulas and compositions of a liquid detergent containing a cleaning solvent that can provide both cleansing ability and sufficient foam performance.

The formulas and compositions as described in the present technology can be used in, for example, light duty liquid detergents. Further, the formulations or compositions of the present technology can be used in, but not limited to, Ready-To-Use kitchen and bath cleaners, dilutable kitchen or bath cleaners, dilutable dish detergent compositions or pre-soak dish detergent compositions, among others.

Desirable attributes of the formulas and compositions of the present technology include an ability of being in liquid form at room temperature; an ability to formulate in cold-mix applications; an ability to foam as good as or better than existing conventional formulations not containing a cleaning solvent utilized in the practice of the present technology, and also providing better soil removal, as well as other properties as described herein.

For household, industrial and/or institutional cleaning products, both the surfactants and solvents are important additional ingredients. Desirable attributes for such products include, for example, the ability to emulsify, suspend or penetrate greasy or oily soils and suspend or disperse particulates, in order to clean articles and/or surfaces and then prevent the soils, grease, or particulates from re-depositing on the newly cleaned surfaces and the continued production of foam in the presence of the soils, oils and/or particulates and/or maintain foam in the presence of soils, oils, and/or particulates being cleaned. In order to optimize these attributes, it has previously been desirable to produce LDLs that contain moderate to high levels of surfactants (e.g., from about 20% to about 100% surfactant based on the total weight of the total compositions) or the addition of cleaning solvents. However, prior to the present technology, LDLs containing such high levels of surfactants were gels, not liquids, at room temperature and LDLs containing cleaning solvents did not have adequate foaming properties. Surprisingly, the formulations of the present technology demonstrate that the addition of a cleaning solvent to LDL formulations provides not only similar foam performance with LDLs not containing such solvent(s), but also enhanced cleaning performance, especially for grease and dried-on food soils. Foaming performance can include the ability of the composition to form a sufficient amount of foam or suds in the wash water initially, as well as the lasting or continuation of the foam throughout the wash process (e.g., foam mileage or capacity). Further, the compositions of the present technology are believed to disperse easily in water upon dilution and leave a shine on metal and glass surfaces.

Some embodiments of the present technology provide one or more compositions containing a sparingly soluble cleaning solvent that typically harms the foam performance of the composition, but due to the selection and ratios of the different primary and secondary surfactants utilized, provide equal foam performance to products designed without the cleaning solvents. For use herein, the term "sparingly-water soluble cleaning solvent" of the present technology and "cleaning solvent" of the present technology are used interchangeably. In some embodiments, the light duty dish detergent compositions of the present technology containing a cleaning solvent provide an increased ability to clean grease and dried-on food on dishware as compared with compositions without the cleaning solvent. In some embodiments, the light duty detergent compositions comprising a cleaning solvent provide desired cleaning ability for grease and dried-on foods while maintaining the desired foaming properties. Further, the compositions provide grease cleaning and foam mileage at low amounts of actives, and thus lower costs. In some embodiments, the compositions of the present technology provide at least equivalent foam performance as compared to a composition not containing any cleaning solvent. In other embodiments, the compositions of the present technology provide better foam performance as compared to compositions containing a cleaning solvent that is not one of the cleaning solvents selected in the present technology.

Although not wanting to be bound by a particular theory it is believed that the compositions of the present technology contain an effective amount of at least one cleaning solvent as a component of an emulsified LDL to provide a composition that is clear, stable and provide consumer-acceptable foam and foam mileage performance. It is further believed that the present technology does not require additional ingredients such as hydrocarbon components or microemulsion technology.

Generally, in the art, cleaning solvents are solvents which have chain lengths of 4 or more carbons, which have some oil dissolving capabilities and usually are sparingly soluble in water. For the practice of the present technology, the term "cleaning solvent" or "sparingly water-soluble cleaning solvent" refers to solvents which have greater than 80% chain lengths from 8 carbons to 16 carbons, preferably greater than 90% chain lengths from 8 carbons to 16 carbons. In some embodiments, the cleaning solvent has greater than 80%, more preferably greater than 90% of solvents with chain lengths from 11 carbons to 15 carbons. In other embodiments, the cleaning solvent is preferably composed of greater that 90% solvents with chain lengths from 12 carbons to 14 carbons in length. In cleaning solvents of the present technology, the cleaning solvents are hydrophobic and only sparingly soluble in water.

The cleaning solvent of the present technology includes one or more solvents having 8 or more carbon atoms, preferably 10 or more carbon atoms. The cleaning solvents of the present technology preferably have from 8 carbon atoms to about 16 carbon atoms, preferably from about 10 carbon atoms to about 15 carbon atoms, and include, but are not limited to, any naturally occurring or synthetic cleaning solvents with 8 to about 16 carbon atoms, for example, but not limited to, 10 carbons, 11 carbons, 12 carbons, 13 carbons, 14 carbons and 15 carbons. These solvents may contain functional groups other than carbon, such as nitrogen in the form of amide, or oxygen in the form of esters, alcohols, or ethers.

Suitable cleaning solvents for use in the present technology include, but are not limited to, amides, ethers, esters or alcohols. Preferred cleaning solvents include, but are not limited to methyl laurate, ethyl laurate, methyl myristate, ethyl myristate, C8-14 dimethyl amides and C8-14 diethyl amides, for example, Steposol® M8-10 (N,N-dimethyloctanamide (N,N-dimethylcaprylamide) and N,N-dimethyl-decanamide (N,N-dimethylcapramide)), Steposol® C-40 (methyl laurate), and Steposol® C-42 (methyl laurate/methyl myristate) commercially available from Stepan Company, Northfield Ill. In some preferred embodiments, the cleaning solvent is a C8-C14 dimethyl amide, preferably Steposol® M8-10.

The LDL detergent compositions of the present technology can include the one or more cleaning solvents in amounts from about 0.5% to about 10% by active weight based on the total weight of the LDL detergent composition, more preferably from about 1% to about 10%, more preferably from about 1% to about 5% active weight based on the total weight of the composition. Alternatively, the cleaning solvent may be in amounts of from about 0.5% to about 9%, alternatively from about 0.5% to about 8%, alternatively from about 0.5% to about 6%, alternatively from about 0.5% to about 4%, alternatively from about 0.5% to about 3%, alternatively from about 1% to about 8%, alternatively from about 1% to about 6%, alternatively from about 1% to about 4%, alternatively from about 2% to about 10%, alternatively from about 2% to about 8%, alternatively from about 2% to about 6% active weight based on the total weight of the LDL detergent composition and can include, but are not limited to, any percentages and ranges in-between, for example, increments of about 0.1, 0.2, 0.3, 0.4, 0.5, 0.6, 0.7, 0.8, 0.9, 1.0, 2.5, 5% and multiplied factors thereof, for example, about 0.5%, about 1%, about 2%, about 2.5%, about 3%, about 4%, about 5%, about 6%, about 7%, about 7.5%, about 8%, about 9%, about 10%.

In some embodiments, the formulations or compositions of the present technology provide sufficient foam performance. Sufficient foam performance for the present technology can be measured as equal to or greater than foaming performance as compared to formulations that do not include a cleaning solvent. Foaming performance can be measured by methods known in the art and include, but are not limited to, foam mileage test as described in the Examples below. Briefly, a first suitable test to measure foam mileage is the Automated Crisco®-only gram test which is a modified version of the Mini-Plate test as disclosed in Anstett, R. M., and E. J. Schuck, JAOCS, "Miniature Dishwashing Evaluation Method" volume 43, October 1966, pp. 576-580. Briefly, a 0.1% solution of the LDL is prepared in 500 grams in 150 ppm hardness water at a starting temperature of the test solution of approximately 120° F. (approximately 50° C.). This wash bath is agitated with a Kitchen-Aid Mixer set on a speed of 6 with a standard whisk, producing copious initial foam. Crisco® shortening, which serves as the soil in this procedure, is titrated into the wash solution at a rate of no more than 0.5 grams per minute with a syringe. The amount of Crisco® tolerated prior to foam collapse is the foam mileage for the formula. A second suitable foam mileage test includes the MiniPlate Test as disclosed in Anstett, R. M., and E. J. Schuck, JAOCS, "Miniature Dishwashing Evaluation Method" volume 43, October 1966, pp. 576-580 but again using Crisco® vegetable shortening as the soil. Briefly, the Mini-plate test places 0.36 grams of Crisco® Shortening Soil on miniplates. One plate is washed every 45 seconds using the composition at a 0.1% concentration in 150 ppm tap water, at a starting temperature of 50° C., until the LDL no longer foams. The number of plates cleaned before the LDL no longer foams is indicative of the foam mileage of the LDL. For embodiments of the present technology, "equal to" or "equivalent" is defined as an amount of foam mileage that is within −20% or greater the foam mileage of compositions not containing the cleaning solvent, more preferably within −10% or greater, on a relative gram or miniplate basis. In some preferred embodiments, the foaming liquid detergent composition exhibits foam performance as measured by foam mileage of at least about 1.6 grams, more preferably at least about 1.8 grams as measured by the automated Crisco-only gram test. In other embodiments, the one or more detergent compositions of the present technology exhibit adequate foam performance as measured by foam mileage of at least 10 plates, preferably at least 12 plates as measured by the miniplate test with Crisco shortening soil. In the present technology, the foam performance is determined and compared between the different compositions which have comparative amounts of total actives within the composition (total actives include both the surfactants and the cleaning solvent). As demonstrated in the examples below, the foam mileage is determined for these embodiments of the present technology in composition where the total actives are about 25% of the total weight of the composition, and preferably are within the range of about 23% to about 27% of the total weight of the composition. One skilled in the art would appreciate that if the total percent actives were increased and/or decreased, that the range of foam performance would be altered. Thus, in the practice of the present technology, the foam performance is measured between compositions with comparable total weight of the actives combined. Thus the foam mileages are calculated relative to the total actives within the composition.

The formulations and/or compositions of the present technology provide cleansing ability greater than the cleansing ability of liquid detergents without the addition of a cleaning solvent. For the purpose of the present technology, the cleansing ability of the formulations or compositions of the present technology are about 10% more than compositions without cleaning solvents, more preferably about 25% more, more preferably about 50% more than a composition without a cleaning solvent. The ability of the formulations or compositions to clean dishes can be measured by methods known to one with skill in the art, and include the method as disclosed in European Patent Publication No. EP 0487169 B1, incorporated by reference in its entirety and demonstrated in the Examples below.

Not to be bound by any particular theory, but it is believed that the ratio of the mixture of the primary and secondary surfactants used in the present technology aid in the solubility of the cleaning solvent into a liquid composition which allows the liquid composition to be soluble in water and easily dilutable for use, and provides the foam mileage in the presence of solvents that are normally known in the art to destroy foam.

The formulations and compositions of the present technology include at least one primary surfactant and at least one secondary surfactant. In the present technology, the at least one primary surfactant is an anionic surfactant and the at least one secondary surfactant is one or more foam stabilizing surfactants.

Conventionally, to provide adequate foaming and cleaning properties desired in the industry, LDL compositions have included a mixture of primary surfactants and secondary surfactants. In these compositions, it is conventionally believed that the compositions comprise a majority of one surfactant (i.e., the primary surfactant) and a minority of the second surfactant (i.e., the secondary surfactant) to provide the necessary cleansing and foaming ability. Not to be bound by theory, it is believed that that primary surfactant is provided to generate foam and the secondary foam stabilizing surfactant provides the stabilization of the foam while washing. Thus, it is believed that conventional compositions have a ratio of primary to secondary surfactant greater than 2:1, which are higher than the ratios of the present technology. In the present technology, it is believed that the ratios used between the primary surfactant and the secondary surfactant are unique in they defy the classical convention of primary and secondary surfactants by being provided in a ratio of between about 1:2 and about 2:1.

In practice of the present technology, the at least one primary surfactant is an anionic surfactant and the at least one secondary surfactant is a foam stabilizing surfactant. The anionic surfactant and foam stabilizing surfactant can be in ratios between about 2:1 to about 1:2 ratio. In some embodiments the ratio of the anionic surfactant to foam stabilizing surfactant is preferably about 1:1 ratio. In some embodiments, the ratio of the primary and the secondary surfactant include, but is not limited to, any ratios inbetween about 2:1 and about 1:2, and in any increments of about 0.1, about 0.2, about 0.3, about 0.4, about 0.5, about 0.6, about 0.7, about 0.8, about 0.9, 1.0 and the like.

In the practice of the present technology, the at least one primary surfactant is an anionic surfactant. In some embodiments, the compositions or formulations of the present technology comprise from about 6% to about 40% active weight based on the total weight of the composition of at least one anionic surfactant. In some embodiments, the composition or formulas of the present technology comprise from about 6% to about 30% active weight based on the total weight of the composition of at least one anionic surfactant; alternatively, from about 6% to about 20%; alternatively, from about 6% to about 15%; alternatively from about 6% to about 12% active weight based on the total weight of the composition, and can include, but are not limited to, any percentages and ranges in between, for example, increments of about 0.1, about 0.2, about 0.3, about 0.4, about 0.5, about 0.6, about 0.7, about 0.8, about 0.9, about 1.0, about 2.5, about 5% and multiplied factors thereof, for example, about 6%, about 7%, about 8%, about 9%, about 10%, about 11%, about 12%, about 13%, about 14%, about 15%, about 16%, about 18%, about 20%, about 22%, about 24%, about 25%, about 27%, about 30%, about 32%, about 35%, about 40% active weight based on the total weight of the composition.

"Anionic surfactants" are defined here as amphiphilic molecules with an average molecular weight of less than about 10,000, comprising one or more functional groups that exhibit a net anionic charge when in aqueous solution at the normal wash pH, which can be a pH of between about 3 to about 11. The anionic surfactant used in the present technology can be any anionic surfactant that is substantially water soluble. "Water soluble" surfactants, unless otherwise noted, include surfactants which are soluble or dispersible to at least the extent of about 0.01% by weight in distilled water at approximately 25° C.

Suitable anionic surfactants of the present technology include, but are not limited to, linear alkyl benzene sulfonates, lauryl sulfates, paraffin sulfonates, lauryl ether sulfates, alpha-olefin sulfonates, methyl ester sulfonates, lauryl sulfoacetates, derivatives thereof including sodium, potassium, magnesium, ammonium, monoethanolammonium, diethanolammonium, and triethanolammonium salts, combinations thereof, among others. Suitable anionic surfactants include, but are not limited to, Steol® CS-270 (sodium laureth sulfate (2EO)), Steol® CS-460 (sodium laureth sulfate (3EO)), Steol® CA-460 (ammonium laureth sulfate (3EO)), Steol® CS-230 PCK (sodium laureth sulfate (2EO)), Bio-Soft® S101 (dodecylbenzenesulfonic acid), Bio-Soft® D-40 (sodium dodecylbenzenesulfonate), Bio-Terge® AS-40 (sodium alpha-olefin sulfonate), Stepanol® WA-Extra K (sodium lauryl sulfate), Stepanol® DCFAS-N (sodium coco sulfate dry needles), and Lathanol® LAL (sodium lauryl sulfoacetate), commercially available from Stepan Company, Northfield Ill. Another group of anionic surfactants for use in the present technology include alkyl methyl ester sulfonates, including, but not limited to, for example, Alpha-Step MC-48 and Alpha-Step PC-48, commercially available from Stepan Company of Northfield Ill., and also including anionic surfactants in U.S. Pat. No. 5,637,758, incorporated by reference in its entirety.

In the present technology, the secondary surfactant is a foam stabilizing surfactant. The foam stabilizing surfactant can be anionic, cationic, nonionic, ampholytic (includes usage of the term amphoteric), amphoteric, zwitterionic, natural or synthetic derivatives or combinations thereof. Suitable foam stabilizing surfactants for use in the practice of the present technology include, but are not limited to, C10-C18 dimethyl amine oxides, C10-C18 amidopropyl dimethyl amine oxides, C10-C18 amidopropyl betaines, alkyl mono- and di-ethanolamides, sulfobetaines, derivatives thereof and combinations thereof, for example, Ammonyx® LMDO (lauramidopropyl/myristamidopropyl amine oxide), Amphosol® LB (Lauryl Amidopropyl Betaine), Ammonyx® LO (lauramine oxide), Ninol® LMP, Ninol® 40-CO, Petrostep® SB, Amphosol® SB, Amphosol® CS-50, and the like which are commercially available at Stepan Company in Northfield Ill.

Some embodiments of the present technology contain the foam stabilizing surfactants in amounts of from about 6% to about 40% active weight based on the total weight of the composition; alternatively, from about 6% to about 30%; alternatively, from about 6% to about 15%; alternatively from about 6% to about 12% active weight based on the total weight of the composition, and can include, but are not limited to, any percentages and ranges in between, for example, increments of about 0.1, 0.2, 0.3, 0.4, 0.5, 0.6, 0.7, 0.8, 0.9, 1.0, 2.5, 5% and multiplied factors thereof, for example, about 6%, about 7%, about 8%, about 9%, about 10%, about 11%, about 12%, about 13%, about 14%, about 15%, about 16%, about 18%, about 20%, about 22%, about 24%, about 25%, about 27%, about 30%, about 32%, about 35%, about 40% active weight to the total weight of the composition.

LDL detergent formulations and compositions of the present technology can comprise from about 1% to about 99%, preferably about 1% to about 90% of at least one carrier. As will be appreciated by at least those skilled in the art, a variety of carriers, vehicles, diluents, and the like are suitable for use in the practice of the present technology. Thus, it will also be appreciated that the terms "carrier", "vehicle", and "diluent" are to be considered non-exhaustive and interchangeable with respect to the present technology and in describing the various formulations, applications, uses, and compositions thereof.

The LDL detergent compositions of the present technology containing at least one cleaning solvent as described herein are preferably in the form of non-emulsion liquids in which water is the principal carrier. The amount of water in a liquid cleaning composition is preferably from about 0% to about 99% by weight of the total composition, alternatively from about 1% to about 90%, alternatively between about 10% and about 90%, alternatively about 10% to about 80% by weight of the total composition. Alternatively, the amount of principal carrier, e.g., water, can be in a percentage as to bring the total percentage of the composition to 100%. In the most concentrated forms of the compositions of the present technology, the carrier may be the solubilizing solvent, or just the cleaning solvent itself.

The foaming liquid detergent compositions of the present technology can further include at least one solubilizing solvent. Solubilizing solvents are solvents that do not provide any enhancement to the cleaning properties of the composition, but increase the clarity and decrease the viscosity of the detergent compositions at room temperature (approximately 25° C.). Solubilizing solvents that may be practiced in connection or conjunction with the present technology include, but are not limited to, 1 to 3 carbon solvents, for example, but not limited to, methanol, ethanol, propylene glycol, isopropanol, and 1,3-propanediol, glycerine, derivatives thereof, combinations thereof, among others.

Such compositions of the present technology can be used in end-use applications including, but not limited to, household, industrial and institutional cleaning products, for example light duty detergent liquids, pre-soak liquids, bath and kitchen hard surface and/or article cleaners and the like. One skilled in at least the cleansing and/or detergent art will appreciate the variety of formulations of the present technology as well as the application thereof.

The LDL detergent compositions of the present technology may be used in a ready-to-use or dilutable kitchen or bathroom cleaner form. Such kitchen and bathroom cleaners include the compositions described herein which are diluted about 1:10 to about 1:1000 with water into a ready-to-use end composition. At the highest dilutions, from about 1:200 up to about 1:1000, the compositions of the present technology may be particularly used on shiny surfaces such as chrome and glass, and can be particularly suitable for removing difficult soils such as dried on grease from cooking. The ready-to-use (RTU) end composition can be used directly on kitchen and/or bath articles and/or surfaces. The compositions of the present technology can also be diluted about 1:10, about 1:50, about 1:100, about 1:200, about 1:500, about 1:1000, or other suitable dilutions in between for use in cleaning articles and/or surfaces in kitchens and baths. Dilutions in the range of 1:1 to about 1:10 are particularly useful as all-purpose cleaners, in the range of about 1:10 to about 1:200 are particularly useful as spray cleaners, and from about 1:200 to 1:1000 are particularly useful on shiny surfaces such as chrome or glass. Further, the formulations and/or compositions of the present technology can be a dilutable kitchen and/or bath surface and/or article cleaner where the composition is diluted about 1:2 to about 1:1000, preferably about 1:100 to 1:1000 for end-use as a surface and/or article cleaner.

Compositions of the present technology can also be used as a pre-soak liquid for cleaning grease, baked-on and dried-on soiled dishware and glassware. Suitable compositions for use as a pre-soak are described herein and include the compositions described herein either undiluted or diluted from 1:1 to about 1:10 with water, alternatively diluted 1:2 or 1:5 with water.

Formulations of the present technology can exhibit viscosities of from about 100 cps to about 6,000 cps; preferably, from about 100 cps to about 2,000 cps, as measured at 25° C. using a Brookfield Viscometer model LV, with spindle 2, 3 or 4 at speeds ranging from about 12 rpm to about 50 rpm. In some embodiments, the formulation or composition has a viscosity between about 100 cps to about 1,000 cps, alternatively between about 100 cps and 800 cps, alternatively between about 200 cps and 800 cps as measured at 25° C. using a Brookfield Viscometer model LV, with spindle 2, 3 or 4 at speeds ranging from about 12 rpm to about 50 rpm.

It is also desirable to have the ability to control the foaming of different household, industrial and/or institutional products depending on the desired end-use application. For example, for one or more light duty liquid detergents of the present technology, it is desirable to have suitable foaming ability along with a pourable viscosity, e.g., a viscosity of about 100 cps to about 2000 cps, more preferably between about 100 cps and about 1000 cps, more preferably between about 200 cps to about 800 cps as measured at 25° C. using a Brookfield Viscometer model LV, with spindle 2, 3 or 4 at speeds ranging from about 12 rpm to about 50 rpm.

It is also desirable for the pH of one or more LDL detergent compositions of the present technology to be in the range in which contact with hands and skin is acceptable while maintaining adequate foaming and cleansing properties. The presently described compositions achieve this need by possessing adequate soil removal and foaming properties at or around neutral pH. LDL detergent compositions of the present technology can have pH values in the range of from about 3 to about 10; alternatively, from about 4 to about 9; and preferably from about 6 to about 8.

In alternative embodiments, one or more formulations or compositions of the present technology can further include at least one antimicrobial agent. The formulations can include at about 0% to about 30% by weight of at least one antimicrobial agent, alternatively about 0.1 to about 20% by weight, alternatively 0.1% to about 10% by weight, alternatively from about 0.5% to about 10%, alternatively from about 1% to about 10%, alternatively from about 1% to about 5% by weight, and may additionally include any range or percentage there between, including, but not limited to, for example, increments of about 0.1, 0.2, 0.3, 0.4, 0.5, 0.6, 0.7, 0.8, 0.9, 1.0, 2.5, 5% and multiplied factors thereof of at least one antimicrobial agent. One or more LDL detergent antimicrobial-based formulations or compositions of the present technology can include from 0% to about 10% by weight of a polyvalent metal ion chelant, alternatively from about 0.1% to about 10%, alternatively from about 1% to about 10%, alternatively from about 1% to about 5% by weight, and may additionally include any range or percentage there between, including, but not limited to, for example, increments of about 0.1, 0.2, 0.3, 0.4, 0.5, 0.6, 0.7, 0.8, 0.9, 1.0, 2.5, 5% and multiplied factors thereof. Such chelants may include polycarboxylic acids and their derivatives, such as succinic acid, citric acid, sodium citrate, ethylene diamine disuccinate, ethylene diamine tetracetic acid, and the like as are known in the art. Further, such antimicrobial-based LDL detergent formulations or compositions of the present technology can include from 0% to about 10% of an alkaline builder, alternatively from about 0.1% to about 10%, alternatively from about 1% to about 10%, alternatively from about 1% to about 5% by weight, and may additionally include any range or percentage there between, including, but not limited to, for example, increasing or decreasing increments of about 0.1, 0.2, 0.3, 0.4, 0.5, 0.6, 0.7, 0.8, 0.9 or 1.0% 2.5%, 5% and multiplied factors thereof such as 1.5×, 2.0×, 3.0×, 4.0×, 5.0× and 6.0× as desired to achieve higher concentrates. Suitable alkaline builders include, but are not limited to sodium carbonate, potassium pyrophosphate, sodium metasilicate, derivatives thereof, combinations thereof, among others.

LDL antimicrobial compositions or formulations of the present technology can also include further antimicrobials which can include, but are not limited to triclosan, n-alkyl dimethyl benzyl ammonium chloride, n-alkyl dimethyl benzyl ammonium chloride, dialkyl dimethyl ammonium chloride, didecyl dimethyl ammonium chloride, dioctyl dimethyl ammonium chloride, phenolics, iodophors, pine oil, methyl salicylate, morpholine, silver, copper, bromine, derivatives thereof, combinations thereof, among others as well as quaternary ammonium compounds, derivatives thereof, and combinations thereof among others.

Suitable antimicrobial agents can be found in *McCutcheons'* 2009 *Functional Materials of North American Edition*, Volume 2, 2009, pages 239-246, which is incorporated by reference in its entirety. Suitable antimicrobial agents include, but are not limited to, Abiol, which is available from 3V Inc. (Brooklyn, N.Y.); Phenobact, which is available from Alzo International, Inc. (Sayreville, N.J.); Emercide 1199, which are available from Cognis Canada Corp. (Mississauga, ON); Bronidox 1160, which is available from Cognis Corporation Care Chemicals (Monheim, Germany); Custom D Urea, Custom DMDM, Custom I Urea, Custom Methyl Paraben, Custom PCMX, Custom PCMX 25%, Custom Propyl Paraben, Salicat K 727, Salicat K100, Salicat K145, Salicat MM, Saligerm G-2, Salinip, which are available from Custom Ingredients, Inc. (Chester, S.C.); Bioban BP-Pharma, Bioban BP-Plus, Bioban CS-1135, Bioban CS-1246, Bioban P-1487, Dowicil 75, Dowicil 200, Dowicil QK-20, Fuelsaver, Oxaban-A (78%), Oxaban-A (90%), Tris Nitro concentrate, Ucarcide, which are available from Dow Chemical Company (Wilmington, Del.) Generic Propylene glycol, which is available from Huntsman Corporation Performance Products (The Woodlands, Tex.); Bronopol, Lexgard 688, Lexgard 690, Lexgard B, Lexgard GMC, Lexgard GMCY, Lexgard M, Lexgard MCA, Lexgard O, Lexgard P, Myacide SP, which are available from Inolex Chemical Co. Personal Care Application Group (Philadelphia, Pa.); Anthium Dioxide, which is available from International Dioxide, Inc. (North Kingstown, R.I.); Germaben II, II-E, Germall II, Germall 115, Germall Plus, LiquaPar Oil, LiquaPar Optima, LiquaPar PE, Liquid Germall Plus, Methyl Paraben, Propyl Paraben, Suttocide A, which are available from International Specialty Products/ISP (Wayne, N.J.); Liposerve DU, Liposerve DUP, Liposerve IU, Liposerve MM, Liposerve PP, which are available from Lipo Chemicals, Inc. (Paterson, N.J.); Dantogard, Dantogard 2000, Dantogard Plus, Dantogard Plus Liquid, Dantogard XL-1000, Dantoserve MS, Dantoserve SG, Geogard 111 A, Geogard 111 S, Geogard 221, Geogard 233 S, Geogard 234 S, Geogard 361, Geogard Ultra, Glycacil, Glycacil 2000, Glycacil SG, Glydant, Glydant 2000, Glydant Plus, Glydant Plus Liquid, Glydant XL-1000, which are available from Lonza Inc. (Allendale, N.J.); Mackstat 2G, Mackstat OM, Mackstat SHG, Paragon, Paragon II, Paragon III, Paragon MEPB, Phenagon PDI, which are available from The McIntyre Group (Norwalk, Conn.); Merguard 1105, Merguard 1190, Merguard 1200, which are available from Nalco Company (Naperville, Ill.); Britesorb A 100, which is available from The PQ Corp (Malvern, Pa.); Generic Methylparaben NF, Generic Propylparaben NF, Generic Ethylparaben NF, Generic Butylparaben NF, which are available from RITA Corp. (Crystal Lake, Ill.); Kathon CG, Kathon CG II, Kathon CG/ICP, Kathon CG/ICP II, Kathon LX 1.5% Microbicide, Koralone B-119 Preservative, Koralone N-105, Kordek MLX, Lanodant DM, Neolone 950, Neolone CapG, Neolone DsP, Neolone M-10, Neolone MxP Preservative, Neolone PE Preservative, Rocima 550 Microbicide, Rocima 586, Rocima 607/Microbicide, Rocima BT 2S, Rocima BT NV 2, which are available from Rohm and Haas Co./Consumer and Industrial Specialties (Philadelphia, Pa.); Vancide TH, which is available from R.T. Vanderbilt Co. Inc. (Norwalk, Conn.); PCMC, which is available from R.W. Greeff and Co., Inc./Howard Hall Div. (Stamford, Conn.); Sepicide HB, which is available from Seppic Inc. (Fairfield, N.J.); Onamer M, Onyxide 200 Preservative, Stepanquat 50NF, Stepanquat 65NF, Stepanquat 200, Stepanquat 1010, Stepanquat 1010-80%, Stepanquat 1210-80%, which are available from Stepan Company (Northfield, Ill.); Grotan, Mergal 142, Mergal 174, Mergal 186, Mergal 192, Mergal 198, Mergal 364, Mergal 395, Mergal 586, Mergal 1000, Mergal K9N, Mergal K10N, Mergal K14, Mergal 1005, which are available from Troy Corporation (Florham Park, N.J.), among others.

Optionally, the LDL detergent compositions or formulations of the present technology can include at least one additive as well. Suitable additives include, but are not limited to viscosity modifiers, electrolytes, thickeners, emollients, skin conditioning agents, emulsifier/suspending agents, solubilizing agents, fragrances, colors, dyes, herbal extracts, vitamins, builders, enzymes, pH adjusters, preservatives, antimicrobial agents, polymers, magnesium sulfate, chloride, or oxide, derivatives thereof, combinations thereof, among others. Enzymes suitable for use in the practice of the present technology include proteases, amylases, and lipases. Polymers suitable for use in the practice of the present technology include, for example, anionic polymers, acrylates, hydroxyethylcelluloses, zwitterionic polymers, gelatins, xanthan gums, polysaccharides, and polyethylene glycols. In some embodiments, the compositions or formulations of the present technology can include hydrotropes as known to one skilled in the art, and include, but are not limited to, sodium xylene sulfonate (Stepanate SXS, commercially available from Stepan Company of Northfield Ill.) and the like.

The compositions and/or formulations of the present technology can be used for soil removing applications such as, but not limited to, for example, washing dishware, cookware, utensils and the like by hand, cleaning bathroom and/or kitchen articles, appliances, surfaces and/or floors.

One skilled in the art will recognize that modifications may be made in the present technology without deviating from the spirit or scope of the invention. The invention is further illustrated by the following examples, which are not to be construed as limiting the invention in spirit or scope to the specific procedures or compositions described therein.

EXAMPLES

Example 1

Exemplary Light Duty Liquid Detergents that Provide Foam and Cleaning Ability Tables 2, 3, and 5 describe formulations of light duty liquid detergent compositions of the present technology that include cleaning solvents that provide good foaming properties and provide improved cleaning over the formulations without cleaning solvents. For each component, "% Active RM" indicates the percents of active material in the material, "Formula % Active" indicates the weight percent of the active material in the liquid detergent formulation, and "Wt. Needed" in grams indicates the calculated amounts added to a formulation having a total weight of 100 grams. Each of these formulations are intended to be liquid detergent formulas and it is contemplated that additional optional components may be added. Formulations are usually made by adding the cleaning solvent, if any, as the last step, to a blend of the water, solubilizing solvent, anionic surfactant, and foam stabilizing surfactant. Trade names used in the following formulations are described further below.

| Trade Name | Chemical Name |
|---|---|
| Ammonyx LO | Lauramine Oxide |
| Ammonyx LMDO | Lauramidopropyl/Myristamidopropyl Amine Oxide |
| Steposol M8-10 | [N,N-dimethyloctanamide (N,N-dimethylcaprylamide) and N,N-dimethyl-decanamide (N,N-dimethylcapramide)] |
| Steol CS-270 | Sodium Laureth Sulfate (2EO) |
| Amphosol LB | Lauryl Amidopropyl Betaine |
| Steposol C-25 | Methyl Caprylate/Caprate |
| Steposol C-42 | Methyl Laurate/Methyl Myristate |
| Ninol LMP | Lauryl/Myristyl Monoethanolamide |
| Stepanol DCFAS-N | Sodium Coco-sulfate |

All of these components are commercially available from Stepan Company, of Northfield Ill.

TABLE 1

Formula 1

| Component | % Active RM | Formula % Active | Wt. Needed (grms) |
|---|---|---|---|
| DI water | 100 | — | 17.02 |
| NaCl | 100 | 1 | 1 |
| Ethanol 40B | 100 | 5 | 5 |
| Ammonyx LO | 30.08 | 9.02 | 29.99 |
| C12-14 amidopropyl sulfobetaine | 41 | 12.3 | 30 |
| Steposol M8-10 | 100 | 3 | 3 |
| Steol CS-270 | 68.59 | 9.6 | 14 |
| | TOTAL BATCH | 33.92 | 100 |

In formula 1, Steposol M8-10 is the cleaning solvent, Steol CS-270 is the anionic surfactant and Ammonyx LO and LMDO Sultaine are the foam stabilizing surfactants. The ratio of primary to secondary in this example is 1:2.2, outside the desired range of 2:1 to 1:2.

TABLE 2

Formula 2

| Component | % Active RM | Formula % Active | Wt. Needed (grms) |
|---|---|---|---|
| DI water | 100 | — | 43.05 |
| Ethanol 40B | 100 | 5 | 5 |
| Ammonyx LO | 30.08 | 9.02 | 29.99 |
| Amphosol LB | 30.19 | 1.5 | 4.97 |
| Steposol M8-10 | 100 | 3 | 3 |
| Steol CS-270 | 68.59 | 9.6 | 14 |
| | TOTAL BATCH | 23.12 | 100 |

In formula 2, Steposol M8-10 is the cleaning solvent, Steol CS-270 is the anionic surfactant and Ammonyx LO and Amphosol LB are the foam stabilizing surfactants. The ratio of primary to secondary in this example is 1:1.1, within the desired range of 2:1 to 1:2. The dimethyl amide cleaning solvent is within the desired chainlength range for foaming of the present technology.

TABLE 3

Formula 3

| Component | % Active RM | Formula % Active | Wt. Needed (grms) |
|---|---|---|---|
| DI water | 100 | — | 43.07 |
| Ethanol 40B | 100 | 5 | 5 |
| Ammonyx LMDO | 33.04 | 9.9 | 29.96 |
| Amphosol LB | 30.19 | 1.5 | 4.97 |
| Steposol M8-10 | 100 | 3 | 3 |
| Steol CS-270 | 68.59 | 9.6 | 14 |
| | TOTAL BATCH | 24 | 100 |

In formula 3, Steposol M8-10 is the cleaning solvent, Steol CS-270 is the anionic surfactant and Ammonyx LMDO and Amphosol LB are the foam stabilizing surfactants. The ratio of primary to secondary in this example is 1:1.2. The dimethyl amide cleaning solvent is within the desired chainlength range for foaming of the present technology.

TABLE 4

| Formula 4 | | | |
|---|---|---|---|
| Component | % Active RM | Formula % Active | Wt. Needed (grms) |
| DI water | 100 | — | 43.00 |
| Ethanol 40B | 100 | 5 | 5 |
| Ammonyx LMDO | 33.04 | 9.9 | 29.96 |
| Amphosol LB | 30.19 | 1.5 | 4.97 |
| Steposol C-25 | 100 | 3 | 3 |
| Steol CS-270 | 68.26 | 9.6 | 14.06 |
| | TOTAL BATCH | 24 | 100 |

In formula 4, Steposol C-25 is the cleaning solvent, Steol CS-270 is the anionic surfactant and Ammonyx LMDO and Amphosol LB are the foam stabilizing surfactants. The ratio of primary to secondary in this example is 1:1.2. The methyl ester cleaning solvent chainlength, however, is outside the range of desirability for foam and not one of the selected cleaning solvents of the present technology.

TABLE 5

| Formula 5 | | | |
|---|---|---|---|
| Component | % Active RM | Formula % Active | Wt. Needed (grms) |
| DI water | 100 | — | 45.21 |
| Ethanol 40B | 100 | 2 | 2 |
| Ammonyx LMDO | 33.04 | 9 | 27.24 |
| Amphosol LB | 30.19 | 1.5 | 4.97 |
| Steposol C-42 | 100 | 3 | 3 |
| Steol CS-270 | 68.26 | 12 | 17.58 |
| TOTAL BATCH | | 25.5 | 100 |

In formula 5, Steposol C-42 is the cleaning solvent, Steol CS-270 is the anionic surfactant and Ammonyx LMDO and Amphosol LB are the foam stabilizing surfactants. The ratio of primary to secondary in this example is 1.14:1.

These formulations were tested against a commercially available product, Ultra Joy commercially available from Procter and Gamble, Cincinnati Ohio, and liquid detergent compositions that contain cleaning solvents that do not fall within the scope of the present technology (see Formulations 1, 4, 6 and 7 in Tables 1, 4, 6 and 7)

TABLE 6

| Formula 6 | | | |
|---|---|---|---|
| Component | % Active RM | Formula % Active | Wt. Needed (grms) |
| DI water | 100 | — | 40.99 |
| Ethanol 40B | 100 | 0 | 0 |
| Ammonyx LMDO | 33.04 | 9.9 | 29.96 |
| Amphosol LB | 30.19 | 3.3 | 10.93 |
| Steposol SB-W | 100.0 | 2.0 | 2.0 |
| Steol CS-270 | 68.26 | 11 | 16.11 |
| TOTAL BATCH | | 26.20 | 100 |

In formula 6, Steposol SB-W (soybean oil, methyl ester) is the cleaning solvent, Steol CS-270 is the anionic surfactant and Ammonyx LMDO and Amphosol LB are the foam stabilizing surfactants. The ratio of primary to secondary in this example is 1:1.2. The cleaning solvent chainlength is outside the range of cleaning solvents desired in the present technology.

TABLE 7

| Formula 7 | | | |
|---|---|---|---|
| Component | % Active RM | Formula % Active | Wt. Needed (grms) |
| DI water | 100 | — | 43.00 |
| Ethanol 40B | 100 | 5 | 5.00 |
| Ammonyx LMDO | 33.04 | 9.9 | 29.96 |
| Amphosol LB | 30.19 | 1.5 | 4.97 |
| Steposol SC | 100 | 3 | 3.00 |
| Steol CS-270 | 68.26 | 9.6 | 14.06 |
| TOTAL BATCH | | 24.00 | 100 |

In Example 7 (Table 7), Steposol SC is not one of the cleaning solvents as described to fall within the selected cleaning solvents of the present technology and the composition does not provide the necessary foam performance.

These formulations were tested for their foaming ability as measured by foam mileage and their cleaning ability. The procedure is the Automated Crisco®-only gram test which is a modified version of the Mini-Plate test as disclosed in Anstett, R. M., and E. J. Schuck, JAOCS, "Miniature Dishwashing Evaluation Method" volume 43, October 1966, pp. 576-580. A 0.1% solution of the LDL is prepared in 500 grams in 150 ppm hardness water at a starting temperature of the test solution of approximately 120° F. (approximately 50° C.). This wash bath is agitated with a Kitchen-Aid Mixer set on a speed of 6 with a standard whisk, producing copious initial foam. Crisco® shortening, which serves as the soil in this procedure, is titrated into the wash solution at a rate of no more than 0.5 grams per minute with a syringe. As the soil is introduced, the foam eventually collapses. The amount of Crisco® tolerated prior to foam collapse is the foam mileage for the formula. This simulates soil being introduced from washing of dirty plates, and measures how many plates could be washed before the foam is gone. The result of foam mileage test is shown in Table 8.

The foam mileage can also be tested using the MiniPlate Test as disclosed in Anstett, R. M., and E. J. Schuck, JAOCS, "Miniature Dishwashing Evaluation Method" volume 43, October 1966, pp. 576-580 but again using Crisco® vegetable softening as the soil. Briefly, the Mini-plate test places 0.36 grams of Crisco® Shortening Soil on miniplates. One plate is washed every 45 seconds using the composition at 0.1% concentration in 150 ppm tap water, at a starting temperature of 50° C., until the LDL no longer foams. The number of plates cleaned before the LDL no longer foams is indicative of the foam mileage of the LDL.

TABLE 8

| Formula | Cleaning % removed | Foam mileage (Grams) | Foam Mileage (std dev) |
|---|---|---|---|
| 1 | 6.1 | 2.91 | 0.55 |
| 2 | 7.46 | 1.62 | 0.2 |
| 3 | 12.27 | 1.7 | 0.42 |
| 4 | 16.09 | 1.56 | 0.24 |
| 5 | 13.18 | 1.87 | 0.04 |
| 6 | 11.24 | 1.48 | 0.36 |
| 7 | 14.63 | 1.42 | 0.42 |
| Ultra Joy | 8.23 | 2.13 | 0.09 |

The ability of the formulations to clean greasy and dried-on soiled dishware was tested using the method as disclosed in European Patent Publication No. EP 0487169 B1, disclosed herein in its entirety but modified to use Tallow as the grease. For this test, 0.1 grams±0.03 grams of tallow is applied to plastic tubes by dipping the pre-weighed tubes in the tallow at room temperature, and scraping off excess with a plastic butter knife to achieve the target soil weight range for each tube. The tubes are then re-weighed and used the same day as they are prepared. Detergent compositions to be tested are prepared at a 0.5% solution at 150 ppm water hardness at approximately 32° C. with 100 dipping cycles at 50 rpm (dips per minute) using a Baumgartner Dipping Apparatus. The warmed detergent solution is maintained at the desired temperature by a circulating water bath. The beakers and soiled tubes are placed in the dipping apparatus which is then run at 100 cycles at 50 rpm. Upon completion of the test cycle, the tubes are removed and air dried overnight and weighed. The soil removal is then calculated by the following formula:

$$\% \text{ cleaned}=[(B-C)/(B-A)]\times 100,$$

where A=the weight of the tube, B=the weight of the tube plus tallow, C=the weight of the tube after washing. A comparison of the average amount of greasy soil removed by the compositions can be seen in Table 8.

The embodiments and examples described here are illustrative, and do not limit the presently described technology in any way. The scope of the present technology described in this specification is the full scope defined or implied by the claims. Additionally, any references noted in the detailed description section of the instant application are hereby incorporated by reference in their entireties, unless otherwise noted.

Example 2

Ultra Concentrate Liquid Detergent Composition

Table 9 contains a prophetic example of an ultra concentrate liquid detergent composition (Formula 8) that may be used as a light duty dish detergent or as a dilutable hard surface cleaner, which could be diluted up to 1:1000.

TABLE 9

Formula 8

| Component | % Active RM | Formula % Active | Wt. Needed (grms) |
|---|---|---|---|
| DI water | 100 | 3 | 3 |
| Ethanol 40B | 100 | 5 | 5 |
| Ninol LMP | 99 | 35.6 | 36 |
| Stepanol DCFAS-N | 91 | 32.8 | 36 |
| Steposol C-42 | 100 | 20 | 20 |
| TOTAL BATCH | | 96.4 | 100 |

The present technology is now described in such full, clear and concise terms as to enable a person skilled in the art to which it pertains, to practice the same. It is to be understood that the foregoing describes preferred embodiments of the present technology and that modifications may be made therein without departing from the spirit or scope of the present technology as set forth in the appended claims. Further the examples are provided to not be exhaustive but illustrative of several embodiments that fall within the scope of the claims.

What is claimed is:

1. A foaming liquid detergent composition comprising:

about 0.5% to about 10% active weight based on the total weight of the composition of at least one sparingly water-soluble cleaning solvent;

about 6.0% to about 40% active weight based on the total weight of the composition of at least one anionic surfactant;

about 6.0% to about 40% active weight based on the total weight of the composition of at least one foam stabilizing surfactant, wherein the ratio of the at least one anionic surfactant to the at least one foam stabilizing surfactant is between about 2:1 and about 1:2; and 0% to about 90% of the total weight of at least one carrier, wherein the at least one sparingly water-soluble cleaning solvent is selected from the group consisting of methyl laurate, ethyl laurate, methyl myristate, ethyl myristate, C12-C14 methyl ester, C8-14 dimethyl amides, C8-14 diethyl amides, derivatives thereof and combinations thereof; and wherein the foaming liquid detergent composition has enhanced foam mileage compared to a composition containing a sparingly water-soluble cleaning solvent other than methyl laurate, ethyl laurate, methyl myristate, ethyl myristate, C12-C14 methyl ester, C8-14 dimethyl amide, or C8-14 diethyl amide.

2. The foaming liquid detergent composition of claim 1, wherein the composition has a foam mileage of at least 10 plates as measured by the mini-plate test with Crisco® shortening soil, when the composition has total actives in an amount of about 23% to about 27% of the total weight of the composition.

3. The foaming liquid detergent composition of claim 1, wherein the ratio of the at least one anionic surfactant to the at least one foam stabilizing surfactant is about 1:1.

4. The foaming liquid detergent composition of claim 1, wherein the anionic surfactant is selected from the group consisting of linear alkyl benzene sulfonates, lauryl sulfates, paraffin sulfonates, lauryl ether sulfates, alpha-olefin sulfonates, methyl ester sulfonates, lauryl sulfoacetates, derivatives thereof including sodium, potassium, magnesium, ammonium, monoethanolammonium, diethanolammonium, and triethanolammonium salts.

5. The foaming liquid detergent of claim 1, wherein the foam stabilizing surfactant is selected from the group consisting of C10-C18 dimethyl amine oxides, C10-C18 amidopropyl dimethyl amine oxides, C10-C18 amidopropyl betaines, C10-C18 amidopropyl betaines, alkyl mono- and di-ethanolamides, sulfobetaines, derivatives thereof and combinations thereof.

6. The foaming liquid detergent composition of claim 1, wherein the composition further comprises from about 0.01% to about 10% of at least one solubilizing solvent.

7. The foaming liquid detergent composition of claim 1, wherein the viscosity of the composition is less than about 2000 cps at 25 degrees C. as measured using a Brookfield Viscometer model LV, with spindle 2, 3, or 4 at speeds ranging from about 12 rpm to about 50 rpm.

8. The foaming liquid detergent composition of claim 1, wherein the composition comprises:

about 0.5% to about 4% active weight based on total weight of the composition of the at least one cleaning solvent;

about 6% to about 15% active weight based on total weight of the composition of the at least one anionic surfactant;

about 6% to about 15% active weight based on total weight of the composition of the at least one foam stabilizing surfactant; and 0% to about 90% by weight of the at least one carrier.

9. The foaming liquid detergent composition of claim 8, wherein the at least one sparingly-water soluble cleaning solvent is C12-C1-4 alkyl C1-2 ester or C8-C10 alkyl dimethyl amide.

10. The foaming liquid detergent composition of claim 8, wherein the at least one foam stabilizing surfactant is lauryl myristyl amidopropyl dimethyl amine oxide.

* * * * *